US007621239B2

(12) United States Patent
Rice

(10) Patent No.: US 7,621,239 B2
(45) Date of Patent: Nov. 24, 2009

(54) HOT WATER HEATER BLANKET ASSEMBLY ESTABLISHING DEAD AIR SPACES

(76) Inventor: Allen C. Rice, Savannah Luggage Works, P.O. Box 447, Vidalia, GA (US) 30475

( * ) Notice: Subject to any disclaimer, the term of this patent is extended or adjusted under 35 U.S.C. 154(b) by 768 days.

(21) Appl. No.: 11/454,276

(22) Filed: Jun. 16, 2006

(65) Prior Publication Data

US 2007/0289451 A1 Dec. 20, 2007

(51) Int. Cl.
*F24H 9/02* (2006.01)
*B65D 90/02* (2006.01)

(52) U.S. Cl. ..... 122/19.2; 220/567.3; 220/694.1

(58) Field of Classification Search ..... 122/19.2, 122/494; 126/344; 220/567.3, 694.1
See application file for complete search history.

(56) References Cited

U.S. PATENT DOCUMENTS

| | | | | | |
|---|---|---|---|---|---|
| 1,240,462 | A | | 9/1917 | Lohse | |
| 1,737,712 | A | | 12/1929 | Gazelle | |
| 1,912,834 | A | | 6/1933 | Geyer | |
| 2,365,086 | A | * | 12/1944 | Kamowski | 220/694.1 |
| 2,563,817 | A | | 8/1951 | Carson | |
| 2,642,851 | A | | 6/1953 | McFerran | |
| 3,358,118 | A | * | 12/1967 | Mather et al | 392/458 |
| 4,039,098 | A | * | 8/1977 | Stilts | 220/694.1 |
| 4,527,543 | A | | 7/1985 | Denton | |
| 5,005,531 | A | * | 4/1991 | Nelson | 122/19.2 |
| 5,020,481 | A | * | 6/1991 | Nelson | 122/494 |
| 5,024,210 | A | | 6/1991 | Nelson | |
| 5,052,347 | A | * | 10/1991 | Nelson | 122/19.2 |
| 5,213,728 | A | | 5/1993 | Hickman | |
| 5,263,469 | A | | 11/1993 | Hickman | |
| 5,408,832 | A | | 4/1995 | Boffito et al. | |
| 5,668,922 | A | * | 9/1997 | Ross et al. | 392/441 |
| 5,677,026 | A | * | 10/1997 | Santoli | 428/76 |
| 5,921,230 | A | | 7/1999 | Vessells et al. | |
| 5,923,819 | A | * | 7/1999 | Ross et al. | 392/441 |
| 5,979,371 | A | | 11/1999 | Lewis | |
| 6,412,448 | B1 | | 7/2002 | Kingston | |
| 6,595,431 | B1 | * | 7/2003 | Lieske | 237/12.1 |
| 6,708,502 | B1 | * | 3/2004 | Aceves et al. | 62/45.1 |
| 2003/0210902 | A1 | | 11/2003 | Giamati | |

FOREIGN PATENT DOCUMENTS

| | | |
|---|---|---|
| GB | 2365102 | 2/2002 |

* cited by examiner

*Primary Examiner*—Gregory A Wilson
(74) *Attorney, Agent, or Firm*—Gene Scott; Patent Law & Venture Group

(57) ABSTRACT

A fabric insulating material is configured for enclosing a hot water heater, and uses strips of insulating material to establish dead air spaced between the fabric and the surfaces of the hot water heater. The dead air spaces function as high efficiency insulators. The fabric is flexible enough to be folded for storage and shipping and is easily applied to common heater units.

12 Claims, 4 Drawing Sheets

HOT WATER HEATER BLANKET ASSEMBLY ESTABLISHING DEAD AIR SPACES

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to insulating methods for tanks and especially hot water heater tanks, and more particularly to a fabric based system for such applications wherein dead air spaces are established as a primary insulating feature.

2. Description of Related Art Including Information Disclosed Under 37 CFR 1.97 and 1.98

Giamati, U.S. 2003/0210902, discloses a heater for installation on a potable water tank. The heater comprises a blanket including an electrical resistance heating element and a connection pad for electrically connecting the heating element to lead lines to an aircraft power source. The water tank is typically positioned under the cabin floor or other locations on an aircraft which are susceptible to cold temperatures, moisture invasion, and pressure drops/rises caused by changing altitudes. The heater maintains the tank at an acceptable temperature range and prevents freezing of the water. Lohse, U.S. Pat. No. 1,240,462, discloses a heat insulating unit comprising a thin block of asbestos provided with projecting flanges, a metallic lath embedded within the block and extending therethrough from edge to edge, and heat insulting pins carried by the block and extending therefrom in a direction lateral to the general plane thereof. Gazelle, U.S. Pat. No. 1,737,712, discloses a water tank of the character described, comprising a main tank, an inlet and outlet pipe connected thereto, an intermediate tank enclosing the main tank and suitably distanced therefrom, means on the inner surface of the intermediate tank to reflect the heat rays radiating from the main tank, an insulating lining located between the bottoms of the tanks, a frame for supporting the tanks, an insulating lining located between the intermediate tank and the frame, and an outer open and superposed casing enclosing the intermediate tank, suitable distanced therefrom and supported upon the frame. Geyer, U.S. Pat. No. 1,912,834, discloses a combined instantaneous and storage water heater comprising, in combination, a storage tank having a vertical tube therein; a flue within and spaced from the tube; a coil of substantially uniform diameter within the flue and connected to the tank; a perforated burner tube extending through the flue and arranged to discharge jets against the coil throughout its height; means for removably supporting the burner tube in the flue; and a fuel supply pipe connected to the burner tube, the coil and burner tube being so arranged as to be removed through the upper end of the flue, a thermostatic element in the tank connected to control the supply of fuel to the burner tube. Mcferran, U.S. Pat. No. 2,642,851, discloses a water heater jacket, in assembly constituting a complete jacket for the walls and top of a water heater, and comprising two members of semi-cylindrical form each having a half-top member, each of the half-top members having half-openings for a vent pipe and fro water fittings, one of the semi-cylindrical members having an aperture for a control window, each member comprising an outer shell member and a lining of insulating material, the members along substantially, the entire length of their meeting side and top edges having cooperating joint forming elements, the joint forming element on one of the semi-cylindrical members comprising an inwardly offset flange, and the joint forming element on the other semi-cylindrical member comprising a flange along the inside of the shell member, spaced therefrom, extending beyond the edge thereof, and terminating ion an outwardly extending bead. Carson, U.S. Pat. No. 2,563,817, discloses a gas fired water heater, comprising a water storage tank having a vertical tube extending therethrough to provide an uptake passage for products of combustion, an outer heat insulating casing enclosing the tank and spaced therefrom along the sides and at the top of the tank to provide a passage for products of combustion over the top of the tank communicating with an annular downtake passage surrounding the tank, the downtake passage having an outlet in the lower portion of the casing for the products of combustion, a gas burner in proximity to the bottom of the tube, and a substantially cylindrical metallic member having its bottom end closed and supported by the top of the burner, the cylindrical member having spirally arranged fins on its outer surface to constitute a convection type heat transfer element in the lower portion of the tube, thereby increasing the transfer of heat by convection from the burned gasses through the tube wall to the water in the lower portion of the tank, the products of combustion thereafter passing upwardly through the tube and thence over the top of the tank and downwardly around the tank to the outlet, whereby the water is heated to a relatively uniform temperature throughout the tank. Mather et al., U.S. Pat. No. 3,358,118, discloses a water heater comprising, in combination, an inner cylindrical pressure tank having water inlet and outlet means, a generally cylindrical two-piece outer shell fully enclosing the pressure tank and adapted for ready dismantlement as to permit replacement of the pressure tank; a base supporting the tank and the shell, the heater including electric heating means, thermostat means for controlling the operation of the heating means, and insulation, the insulation being attached to the inside surface of the outer shell, and means for holding the heating means and thermostat means within the shell and in removable juxtaposition with the outer surface of the sides of the pressure tank, the holding means consisting of a standard carried by and projecting upwardly from the base within the shell and between the shell and the pressure tank, the standard being adjustable in height as to permit height adjustment of the heating means. Denton, U.S. Pat. No. 4,527,543, discloses a water heater including a tank, a cylindrical jacket, surrounding the tank to provide an insulating space therebetween and a cover member mounted on top of the jacket to close off the top of the insulating space. An insulating wall is provided in the insulating space between the tank and the jacket. The insulating wall is comprised of a plastic envelope member and a wall of insulating material which has been foamed-in-place inside the envelope member. Nelson, U.S. Pat. No. 5,020,481, discloses a thermal insulating jacket for use around pipes, conduits, tanks and related members that includes a flexible outer covering such as a sheet of plastic or polyvinylchloride which has bonded to its surface an alternating series of insulation material strips. The insulation material strips which are bonded to the flexible outer covering include a first plurality of flexible insulation material strips and a second plurality of rigid insulation material strips. These different material strips are arranged in alternating sequence and the combination of outer covering and insulation strips is sufficiently flexible and formable so as to be wrapped into a generally cylindrical shape which may then be disposed around a pipe, conduit, tank or related member, for thermally insulating that member. The outer covering may be a one-piece member or a hinged member. Nelson, U.S. Pat. No. 5,024,210, discloses a water heater for containing water surrounded in spaced apart relationship by an outer shell that includes a sleeve of insulation material, such as fiberglass, located in the annular space between the inner tank and outer sleeve. The top edge of the insulation sleeve includes an annular cuff which is of a radial thickness greater than the radial thickness of the rest of the insulation sleeve such that the cuff is compressed between the interior wall surface of the outer shell and exterior wall surface of the inner tank. An expanded foam thermal insulation material fills the annular space above the cuff of the insulation mat. A method of making a water heater includes the steps of locating a sleeve of insulation material around the exterior wall surface of the inner tank, folding the top end of the insulation sleeve back over itself to form an annular cuff, and positioning the outer shell concentrically over the inner tank whereupon the annular cuff is compressed between the interior wall surface of the outer shell and exterior wall surface of the inner tank. The annular space above the annular cuff of the sleeve is then filled with an expandable foam insulation material which is allowed to foam in situ. Hickman, U.S. Pat. No. 5,213,728, discloses a method for foam insulating a water heater where the water heater has an outer shell and an inner tank with tank fittings, the outer shell having tank fitting openings and the inner tank and outer shell being separated by an insulation space. The method comprises locating foam flow barriers between the inner tank and the outer shell around the periphery of each of the tank fitting openings and then spraying foam forming material into the insulation space with the foam barriers preventing the foam from escaping outwardly through the tank fitting openings. Hickman, U.S. Pat. No. 5,263,469, discloses a method for foam insulating a water heater where the water heater has an outer shell and an inner tank with tank fittings, the outer shell having tank fitting openings and the inner tank and outer shell being separated by an insulation space. The method comprises locating foam flow barriers between the inner tank and the outer shell around the periphery of each of the tank fitting openings and then spraying foam forming material into the insulation space with the foam barriers preventing the foam from escaping outwardly through the tank fitting openings. Boffito et al., U.S. Pat. No. 5,408,832, discloses an improved process for evacuating the thermally insulating jacket of a dewar having an inner wall and an outer wall, with the inner space between said walls completely or partially filled with an insulating material, containing also a moisture sorbing material and a getter material, in which said moisture sorbing material is a chemical drying agent. Vessells et al., U.S. Pat. No. 5,921,230, discloses an insulating mechanism for a gas water heater designed to increase the efficiency thereof. The device comprises a blanket formed of a pair of arcuate, adjacent panel members having top and bottom edges with a pair of opposing side edges therebetween. Adjacent side edges of the panel members are hingedly joined with the opposing side edges being selectively attachable to form a cylindrical blanket that encases a water heater storage reservoir. A piping system is disposed within each panel member for circulating waste gas therethrough. An exhaust duct is disposed on the top surface of a water heater outer shell and is in communication with the interior thereof. A hinged baffle divides the duct into an upper and lower chamber both of which are in communication with the piping system. A fan is disposed within the lower chamber and forces hot waste gas from within the outer shell through the blanket and out the top of the duct thereby providing a heated, insulating blanket for the water storage reservoir. Lewis, U.S. Pat. No. 5,979,371, discloses a foam distribution jacket for containing an insulating expandable liquid foam mixture prior to expansion into a space between a hot water tank and an outer casing secured thereabout. The jacket comprises a pair of sheets which are superimposed to define a bottom trough section having a straight bottom edge and opposed end edges. A seal is formed along the straight bottom edge and the opposed end edges to form the trough and to interconnect the sheets. The pair of sheets converge to a crest portion at a top end section thereof. An attachment hole is provided in the crest of an inner one of the pair of sheets) and is adapted to attach the jacket in a depending manner from a nipple in a top wall of a hot water tank. The method of insulating a surrounding space formed between the hot water tank and the outer casing using the foam distribution jacket is also described. Kingston, U.S. Pat. No. 6,412,448, discloses a flexible, water impervious liner that is fitted in a rigid outer shell. The shell has an open top with a peripheral flange over which a top lip of the liner is fitted. A separate top plate attaches to the flange with standard fasteners for clamping the liner to the shell. Through hull fittings are provided for heating elements at the side and inlet/outlet fittings at the top. The construction allows convenient access to virtually all components of the water heater, including the liner and the heating elements, so that they can be quickly and easily serviced or replaced. A desired amount of insulation can be provided by an appropriate cover or blanket to surround the outer shell. Lieske, U.S. Pat. No. 6,595,431, discloses a exhaust heat trap and redirecting system for utilizing exhaust heat that includes an electric generator that includes an internal combustion engine. The electric generator is electrically coupled to an electrical system of a dwelling. An exhaust conduit is fluidly coupled to the engine for venting exhaust away therefrom. A substantially airtight sheath is positioned about a water tank in a water heater. The sheath comprises a cylinder having an inner wall and an outer wall. The sheath has an upper wall attached to the outer wall. A sheath inlet has a first end fluidly coupled to the sheath and a second end fluidly coupled to the exhaust conduit. A sheath outlet has a first end fluidly coupled to the upper wall of the sheath and a second end is directed outward of the dwelling. Shigemi, JP 6229504, discloses a casing structure for a furnace wall of a boiler wherein even if a boiler is started and stopped frequently, exhaust gas of high temperature does not directly contact a metal plate or an expansion plate so that the metal plate and expansion plate can be kept at a low temperature. The casing structure of the furnace all of a boiler, the end of a water-tube furnace wall and the end of a steam-tube furnace wall are positioned at right angles spaced apart a vertical gap from each other and a L-shaped metal plate having a plurality of horizontal gaps and an expansion plate of U-shape are provided so as to surround the vertical gap. And one of the surfaces of the plate extends along the wall and the other surface thereof extends along the wall and the opposite ends thereof in a horizontal direction are joined to the water-tube furnace wall and the steam-tube furnace wall, and the upper and lower ends of the expansion plate are joined to the L-shaped metal plate so as to hold a horizontal gap therebetween. Further the flexible insulating material is filled into between the walls and the metal place and also is filled into the interior of the plate. Vallis, GB 2365102, discloses a water heater comprising a lower reservoir for heated water and an upper cold water feed/expansion reservoir which are interconnected by a cold water supply pipe and a hot water expansion pipe, the expansion pipe is insulated from the water in the cold water reservoir. This prevents heat from the expansion pipe warming up the cold water in the reservoir sufficiently to allow harmful bacteria to develop. The expansion pipe may be insulated by means of a sleeve of thermally insulting material surrounding and in contact with the pipe. Alternatively, the sleeve is of copper and surrounds the pipe with an air gap. The end of the pipe has a U-bend. The reservoirs are separated by an air gap or by thermally insulating material and pipes are made of material which is resistant to the flow of heat through it or fastened by insulated collars. The cold water reservoir has a temperature sensor which generates an alarm signal if the temperature exceeds 39° C. This educes the risk of bacterial growth which can cause legionnaires disease. The alarm signal may produce an audible and/or visible alarm, either immediately or after a predetermined time, or may activate a valve to prevent flow from the water heater. Alternatively the temperature sensor may just change color, or from transparent to opaque, to indicated to a service engineer that the temperature has been exceeded since the last visit.

The related art described above discloses a variety of approaches to providing thermal insulation to a tank. For instance, McFerran, Giamati, GB 2365102, Buffito et al, Kingston, Hickman, Nelson, Denton and Mather at al, all teach that insulation material is best when in contact with the tank to be insulated. In contrast, Lieske, Carson, Gazelle, Lohse and Geyer all teach placement of rigid walls leaving a dead air space between the wall and the tank. For instance, Geyer uses sheet metal, Hohse uses asbestos in a metallic lath, Gazelle uses galvanized tin, Carson teaches an insulating material between sheet metal walls, and Lieske teaches rigid walls with passages for hot air to pass. However, the prior art fails to disclose an apparatus made of a multi-layer flexible fabric with integral spacers for establishing dead air spaces between the fabric and the tank. Such materials are less expensive to manufacture, ship, store and employ due to the fact that they can be folded compactly, are light weight and simple to assemble and install. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A flexible fabric insulating material is configured for enclosing a hot water heater, and uses integral strips of insulating material to establish spaces between the fabric and the surfaces of the hot water heater. The dead air spaces function as high efficiency insulators. The fabric is flexible enough to be folded for storage and shipping and is easily applied to common heater units. In particular, the invention provides a blanket wrapped about the hot water heater and a cover that fits over the top of the heater, and in addition, one or more disks between the cover and the top of the water heater. As shown in the figures enclosed herewith, the invention produces a dead air space around the side of the water heater, and a separate dead air space above the water heater. Since heated air rises, by trapping such heated air at the side of the water heater, cooler air is not able to enter the dead air space and the heated air trapped in the dead air space provides improved insulation against thermal transport across the jacket. The dead air space above the water heater is preferably separated into at least two vertically separated dead air spaces so that the lower one, being heated to an equilibrium temperature with the top surface of the water heater, reduces thermal transport from the heater to the upper one of the two dead air spaces, and, the upper dead air space, reaching thermal equilibrium above ambient air temperature, functions to isolate the lower space.

A primary objective inherent in the above described apparatus and method of use is to provide advantages not taught by the prior art.

Another objective is provide a flexible fabric insulating material system that is easily stored in a folded compact configuration but may be unfolded and installed about a hot water heater.

A further objective is to provide such a system that provides insulating spacers that enable the creation of dead air spaces around the surfaces of a hot water heater.

A still further objective is to provide such a system that is inexpensive and yet has a high insulating value.

A still further objective is to provide such a system that is quickly installed about a hot water heater.

A still further objective is to provide such a system that isolates a dead air space around the sides of a hot water heater from a dead air space at the top of the water heater.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 2:
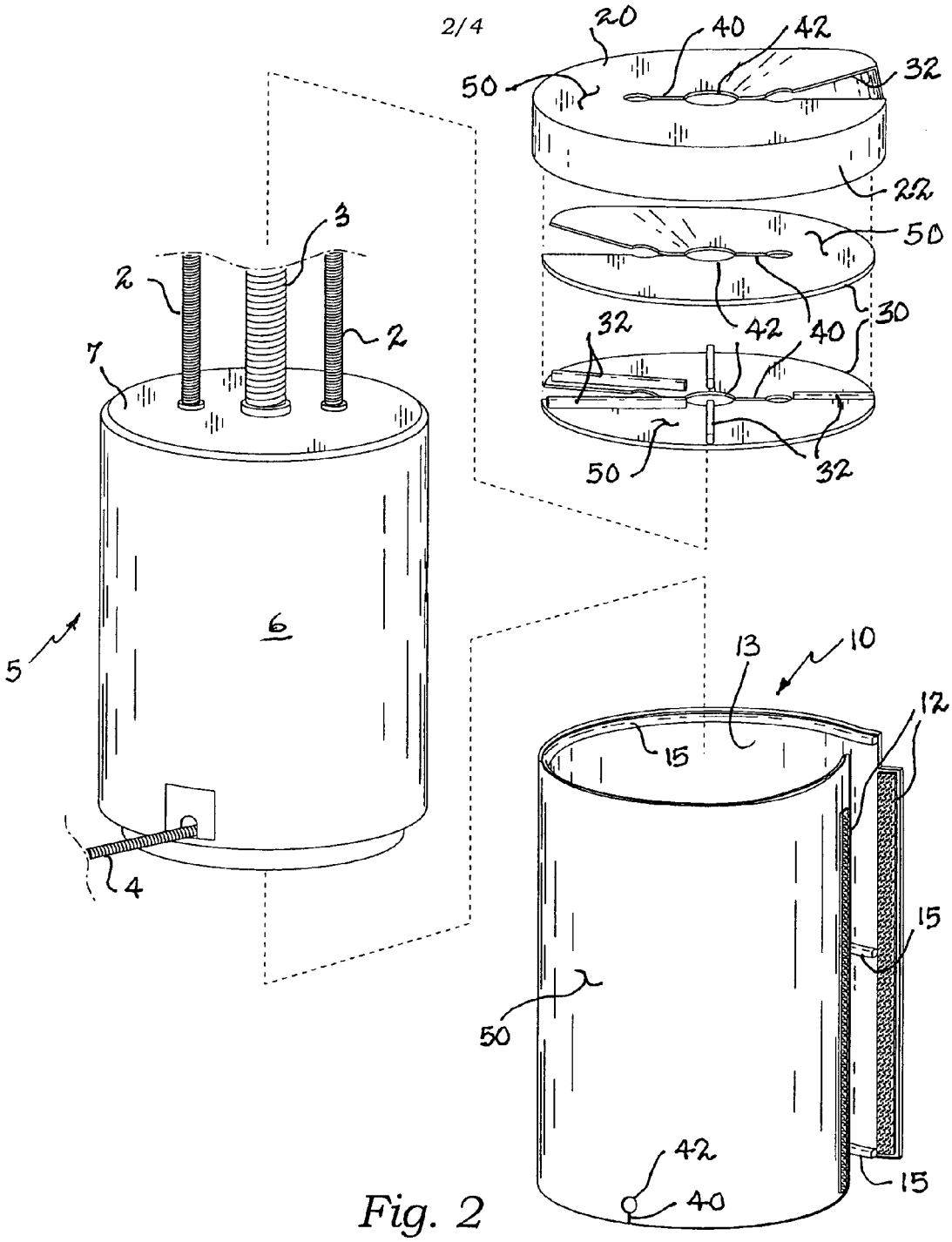
FIG. 2 is an exploded perspective view thereof showing separately, the water heater, insulating blanket, insulating top cover, and a pair of insulating isolation disks.

Described now in detail is an apparatus for insulating a water heater 5 in order to reduce thermal transport from the heater's external surfaces to the ambient air. Such heaters are well known and in general use in residences and businesses, and they operate either by electric resistance heating or by a gas firebox with a heat exchanger. In both types of heaters several utility elements are mounted exterior to the surfaces of a water enclosing tank which tank generally is configured with a cylindrical side wall 6 closed by a round top plate 7. The more complex device is the gas-fired hot water heater. This type of heater generally has hot and cold water pipes 2 and a flue 3 extending upwardly from the top plate 7, and a drain pipe 4 extending outwardly from the side wall 6 as shown in FIG. 2. Additionally, such a heater typically has a top mounted emergency relief valve with an external overflow down-pipe, one or more thermostats, and a burner control unit, all of which are not shown in the figures. The present invention apparatus is adapted for insulating either an electric or a gas hot water heater with a fabric insulating material fashioned as several separate elements which together cover the water heater 5 and produce dead air spaces adjacent to the water heater 5 thereby isolating the water heater 5 from ambient air.

Figure 3:
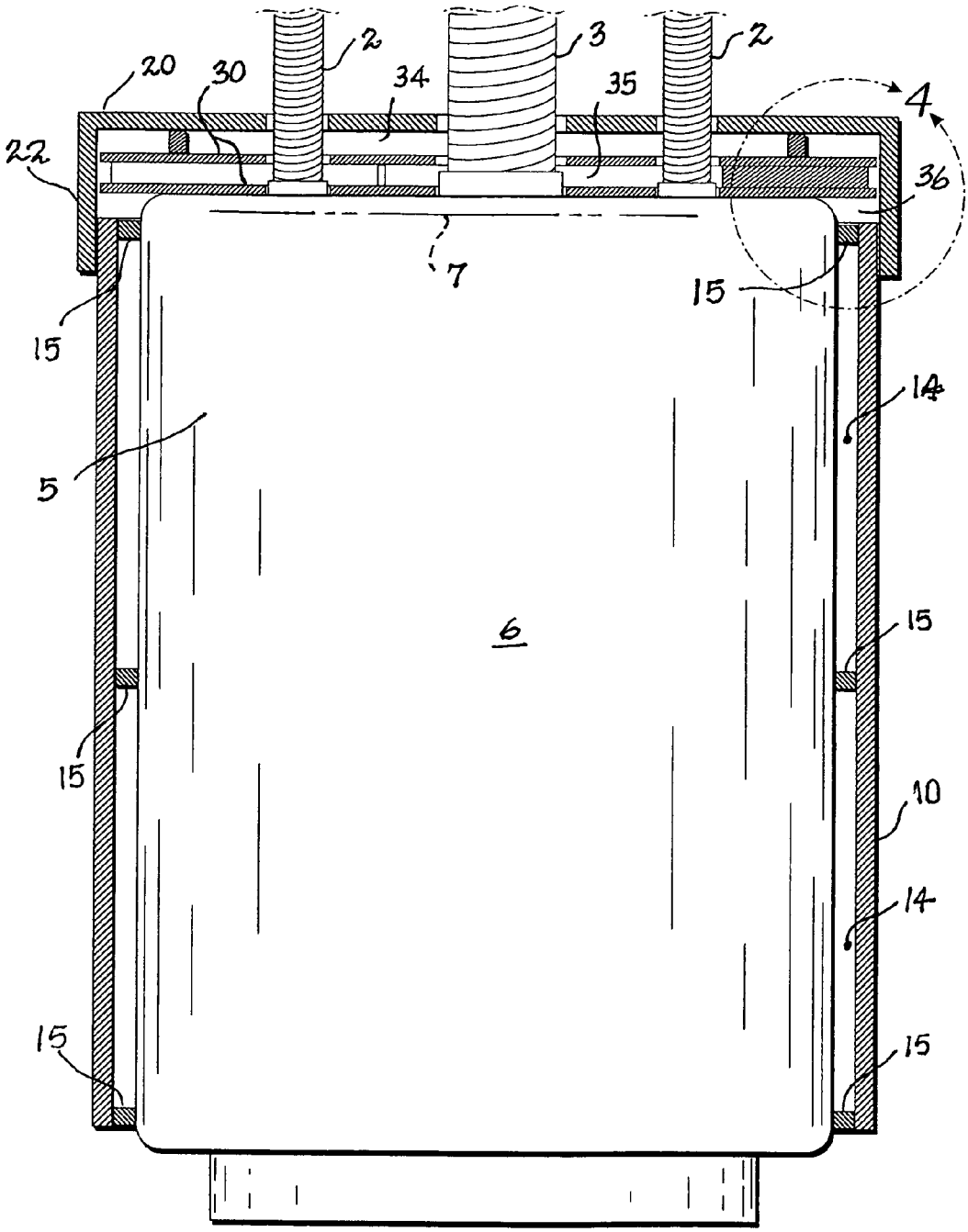
FIG. 3 is a cross-sectional view thereof taken along section line 3-3 in FIG. 1, a vertical section of the present invention but not the workpiece, water heater and its utility elements.
Figure 4:
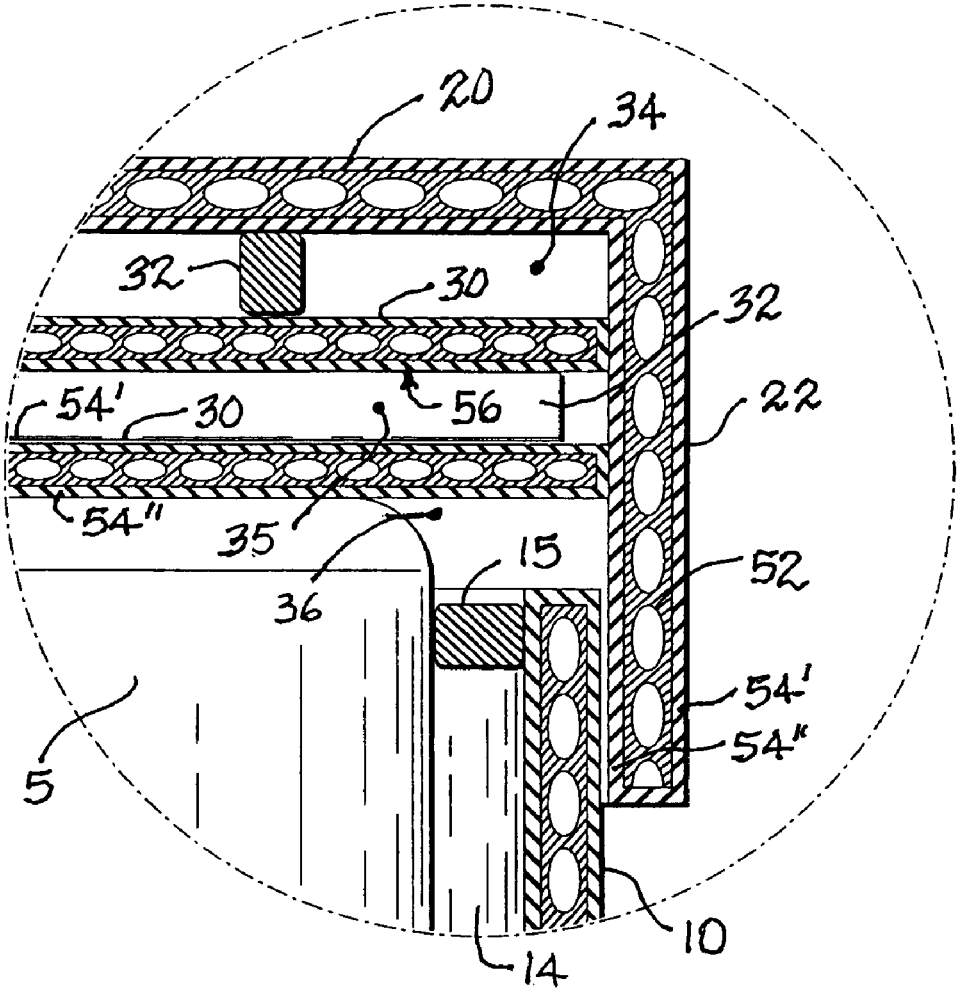
FIG. 4 is a enlarged view of that portion of FIG. 3 shown by partial cutaway line 4.

FIG. 2 shows the separate elements of the present invention include a rectangular blanket 10 having a fastener 12 enabling securement of the blanket 10 about the side wall 6 of the water heater 5. Fastener 12 is preferably hook and loop fastener material as shown, but may be any other common fastener. A first spacer 15 is formed integrally with an inside surface 13 of the blanket 10 and is positioned for establishing a first dead air space 14 (FIGS. 3 and 4) between the water heater side wall 6 and the blanket 10. A disk shaped top cover 20 has an integral downwardly extensive cylindrical side portion 22 of such diameter as to abut the blanket 10 when the blanket 10 is in place around the water heater 5 as shown in FIGS. 3 and 4. This abutting relationship between the blanket 10 and side portion 22 secures a dead air space 36 as shown in FIG. 4. One or more isolation disks 30 are positioned between the top cover 20 and the top plate 7 of the water heater 5. A second spacer 32 is integral with one or more of the disks 30. The second spacer 32 is of an extent and size so as to establish a second dead air space 34 between the top cover 20 and the disk 30, and a third dead air space 36 between the disk 30 and the top plate 7 of the hot water heater 5. It is noted that the term "disk" is used herein to mean one, or more-than-one such disks 30 as shown in FIGS. 3 and 4. Preferably, the disk(s) 30 abut(s) the cylindrical side portion 22 of the top cover 20, thereby mutually isolating the dead air spaces 34 and 36.

Figure 1:
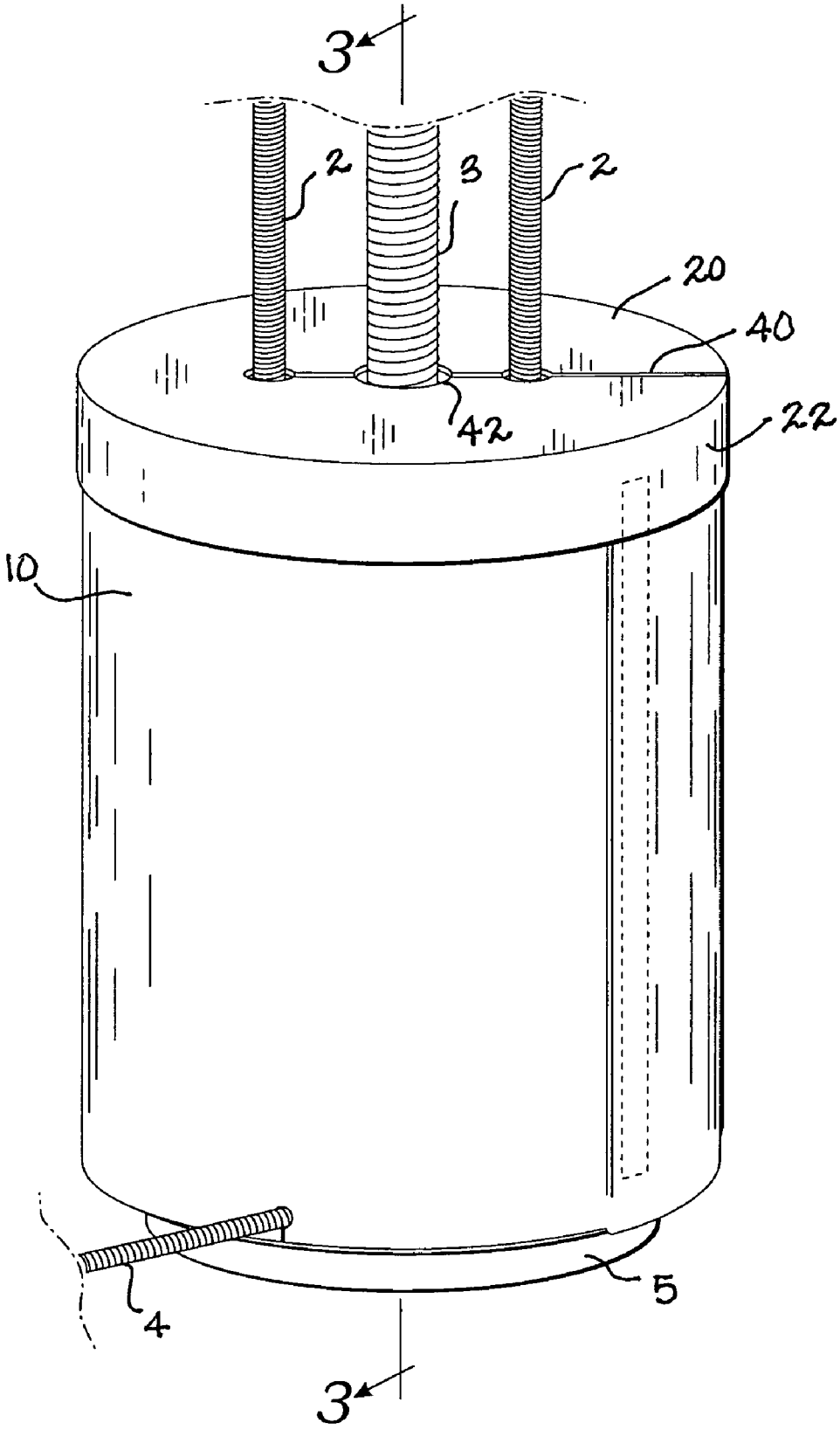
FIG. 1 is a perspective view of the presently described apparatus as installed on a hot water heater.

As shown in FIGS. 1 and 3, the individual elements 10, 20 and 30 provide access for the utility elements servicing the water heater 5 including inflow and outflow water pipes 2, flue 3 and drain pipe 4, and such access facilitation includes slits 40 and apertures 42 in the fabric of the individual element 10, 20 and 30. The slits 40 and apertures 42 are sized to enable the elements 10, 20 and 30 to be placed around the utility elements yet still providing good insulating properties and maintaining the established dead air spaces, i.e., they are tight fitting. This approach enables the apparatus to be compatible with other utility elements of the types previously described, and one of skill in the present art would have little difficulty in adapting the present apparatus to such elements.

Preferably, the insulting fabric material 50 comprises a bubble-wrap core 52 sandwiched between a pair of plastic film sheets 54' and 54" (FIG. 4) and preferably, at least one of the plastic film sheets 54' and or 54" has a reflective metallized layer 56 deposited on it. It is well known that such a metallic layer 56 is suited for limiting radiant heat loss. Such a layer 56 is commonly used on roof sheeting and similar products for that same purpose. It is noted that the bubble-wrap core 52 comprises the very well known packing material of the same name and the film sheets 54' and 54" may be of any one of the thin engineering plastic sheet materials such as polyester, polycarbonate, polyethylene, and polypropylene, for instance. Preferably, the outer one of the film sheets 54' is dense black in color or white in color depending upon whether the water heater is in a location suitable for absorbing heat from the environment or not. Black color helps the material 50 absorb any external heat that may be present, which, in turn, helps to lower the thermal delta across the material.

The term "spacer" as used herein refers to one or more, i.e., singular or plural, strips of an insulating material such as cloth, fiber, foam and the like. Preferably, the first spacer 15 is positioned at opposing, upper and lower, side edges of the blanket 10, as best seen in FIG. 3 so as to produce the first dead air space 14 which extends over the entire exterior of the side wall 6 of the water heater 5. One or more portions of the first spacer 15 may also be placed midway between the side edges of the blanket 10, as shown in FIG. 3 to help maintain the dead air space, i.e., that the flexible fabric material 50 is held at a distance from the water heater 5. The second spacer 32, as best shown in FIG. 4, may be integral with the isolation spacers 30 or with the top cover 20, or both, and are used to assure isolation between the top cover 20 and the upper spacer 30, i.e., creating dead air space 34, as well as between the spacers 30 creating space 35. If only one spacer 30 is employed, then second spacer 32 is placed integrally on both of its opposing surfaces and a further dead air space is created between the top plate 7 of the water heater 5 and the isolation spacer 30 (not shown).

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus for insulating a water heater, the water heater having a cylindrical side surface, a circular top surface and a plurality of utility elements extending outwardly therefrom; the apparatus comprising: a flexible insulating material formed as:

a rectangular blanket having a fastener enabling securement of the blanket about the side surface of the hot water heater, a first spacer integral with, and positioned on an inside surface of the blanket for establishing a dead air space between the side surface of the water heater and the inside surface of the blanket when the blanket circumvents the water heater;

a top cover having a cylindrical side portion of a size for mutual abutment of the side portion and the blanket when the blanket and the top cover are engaged with the water heater;

an isolation disk positioned in parallel with the top cover and extensive so as to peripherally abut the side portion; a further spacer integral with at least one of the isolation disk and the top cover, the further spacer positioned for establishing a further dead air space between at least one of the top cover and the isolation disk and the isolation disk and the top surface of the water heater when the top cover and the isolation disk are engaged over the water heater.

2. The apparatus of claim 1 wherein the insulting material comprises a bubble-wrap core sandwiched between a pair of plastic film sheets.

3. The apparatus of claim 2 wherein an outwardly facing one of the pair of plastic film sheets on at least one of the blanket and the top cover is colored one of while and black.

4. The apparatus of claim 1 wherein at least one of the plastic film sheets has engaged therewith a reflective metallized layer.

5. The apparatus of claim 1 wherein the first spacer is positioned at opposing upper and lower side edges of the blanket such that the first dead air space is limited to the extent of the blanket.

6. An apparatus for insulating a water heater, the water heater having a side surface, a top surface and a plurality of utility elements extending outwardly therefrom; the apparatus comprising: a flexible insulating material having a bubble wrap layer formed as:

a blanket having a fastener enabling securement of the blanket about the side surface of the water heater, a first spacer integral with, and positioned on an inside surface of the blanket for establishing a dead air space between the side surface of the water heater and the inside surface of the blanket when the blanket circumvents the water heater;

a top cover having a cylindrical side portion of a size for mutual abutment of the side portion and the blanket when the blanket and the top cover are engaged with the water heater;

an isolation element positioned within the top cover and peripherally abutting the side portion thereof; a further spacer integral with at least one of the isolation element and the top cover thereby establishing a further dead air space therebetween.

7. The apparatus of claim 6 wherein the material has deposited thereon a reflective metallized layer.

8. The apparatus of claim 7 wherein at least one surface of at least one of the blanket and the top cover is colored one of white and black.

9. The apparatus of claim 6 wherein the first spacer is positioned so as to limit the extent of the first dead air space to the extent of the blanket.

10. An apparatus having low thermal loss comprising:

a) a water heater providing a peripheral side surface closed at an upper end thereof by a top surface; and b) a flexible insulating material having a bubble wrap layer formed as:

i) a blanket secured about the side surface of the water heater in a position establishing a dead air space therebetween;

ii) a top cover extensive over the top surface of the water heater in a position establishing a further dead air space therebetween;

iii) an isolation element within the top cover, the element vertically bisecting the further dead air space;

the insulating material of such dimension and physical extent as to thermally isolate the dead air space, and each of the bisected portions of the further dead air space.

11. The apparatus of claim 10 wherein the insulating material has, on at least one portion thereof, a reflective metallic outer surface.

12. The apparatus of claim 10 wherein the insulating material has, on at least one portion thereof, an outer surface colored one of white and black.

* * * * *